United States Patent [19]

Elam

[11] Patent Number: 4,840,048

[45] Date of Patent: Jun. 20, 1989

[54] HANDCUFF RESTRAINING APPARATUS AND METHOD OF USE

[76] Inventor: Dennis C. Elam, 2606 Pawnee No. 8, Garden City, Kans. 67846

[21] Appl. No.: 96,270

[22] Filed: Sep. 9, 1987

Related U.S. Application Data

[63] Continuation of Ser. No. 898,660, Aug. 21, 1986, abandoned.

[51] Int. Cl.[4] ..... E05B 75/00

[52] U.S. Cl. ..... 70/16

[58] Field of Search ..... 70/16, 17, 14; 224/198, 224/199, 911, 912, 914, 242; D22/13

[56] References Cited

U.S. PATENT DOCUMENTS

| | | | |
|---|---|---|---|
| 647,735 | 4/1900 | Widmayer | 70/16 |
| 829,197 | 8/1906 | Eisaman | 70/17 |
| 1,197,549 | 9/1916 | Russell | 70/17 |
| 1,413,290 | 4/1922 | O'Leary | 70/17 |
| 1,700,047 | 1/1929 | Harvey | 70/17 |
| 1,803,280 | 4/1931 | Stull | 70/16 |
| 3,143,262 | 8/1964 | Sullivan | 224/914 |
| 3,616,665 | 11/1971 | Rosenthal | 70/16 |
| 3,740,977 | 6/1973 | Stefansen | 70/16 |
| 3,870,208 | 3/1975 | Theodore | 224/914 |

*Primary Examiner*—Robert L. Wolfe
*Attorney, Agent, or Firm*—Phillip A. Rein

[57] ABSTRACT

This invention relates to handcuff restraining apparatus and the method of use thereof by an arresting officer on rendering a suspect helpless and under control. The handcuff restraining apparatus includes a handcuff restraining assembly releaseably mounted within a handcuff holster assembly. The handcuff restraining assembly includes a sustantially conventional handcuff assembly having a restraining assembly mounted between two (2) handcuff bracelet members which are interconnected by a connector chain member. The handcuff assembly resembles a conventional handcuff assembly but the restraining assembly includes a main handle assembly to interconnect the normally pivotal handcuff bracelet members in a rigid manner for the proper use thereof. The main handle assembly is provided with curved finger wall sections, arcuate end walls, thumb side walls, and curved outer support walls so to be readily grasped by the restraining officer for inclining and twisting thereof when placed on a suspect's wrist area to achieve the new and novel operation of this invention. The method and use of this invention provides new and novel steps for restraining a suspect without the use of police clubs, pistols, and, prevents bodily injury to the suspect. Additionally, the handcuff restraining apparatus allows the restraining officer to quickly subdue the suspect which lessens the possibility of injury to the arresting officer.

15 Claims, 3 Drawing Sheets

FIG. 1
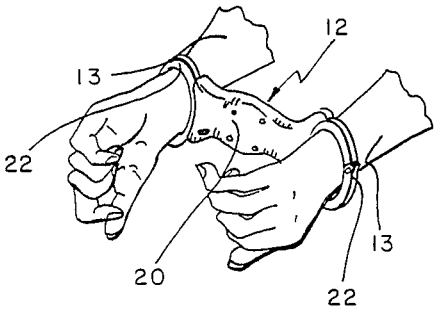
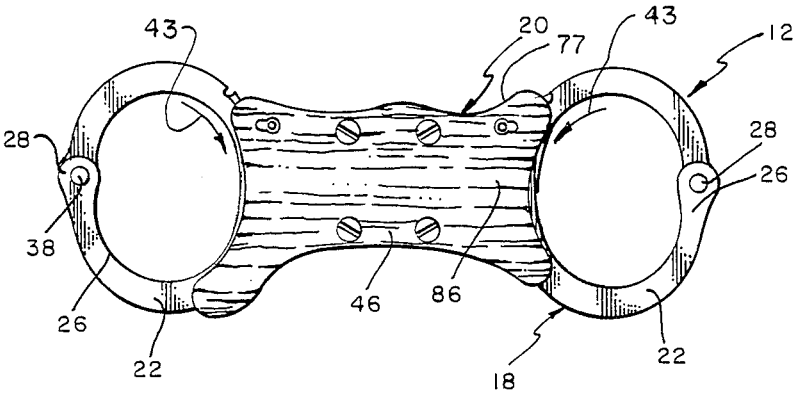
FIG. 2
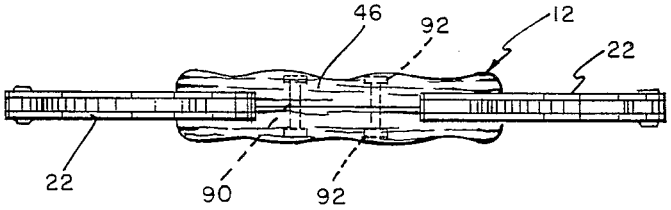
FIG. 3
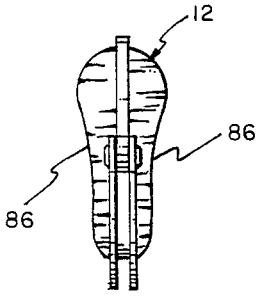
FIG. 4

FIG. 6
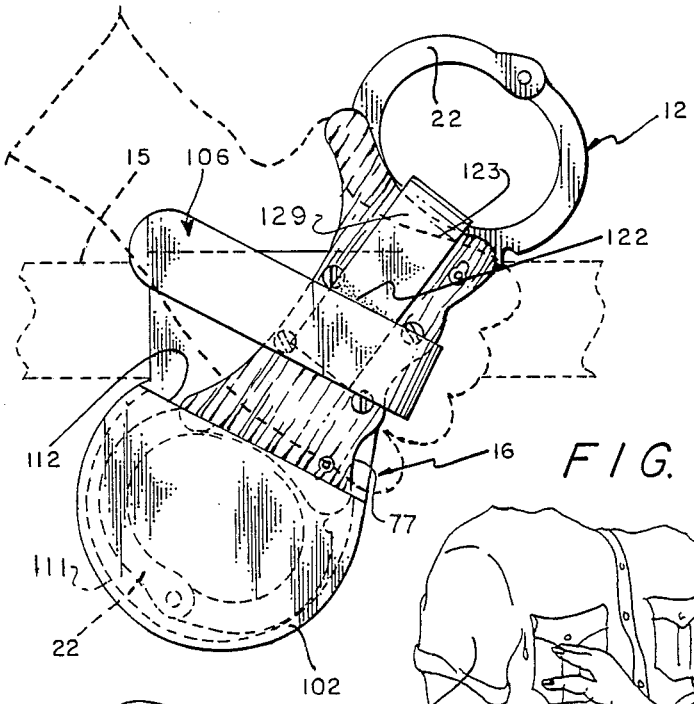
FIG. 7
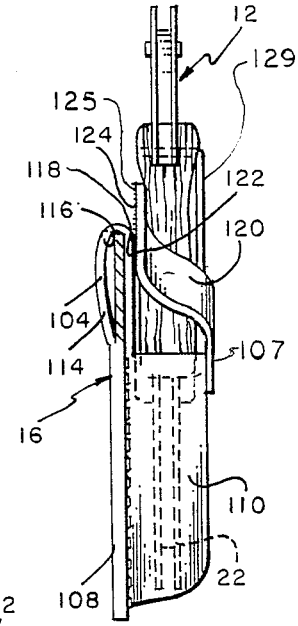
FIG. 9
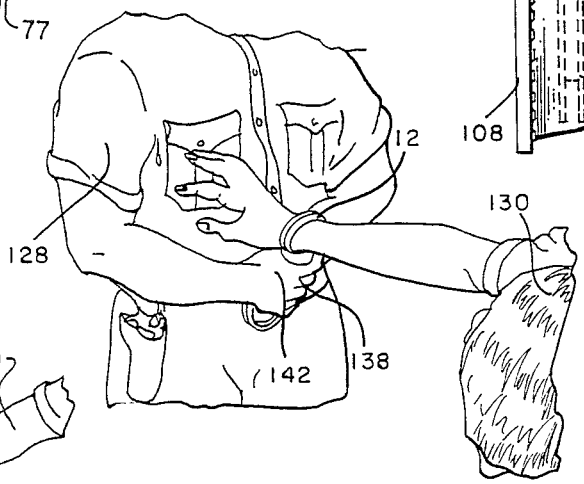
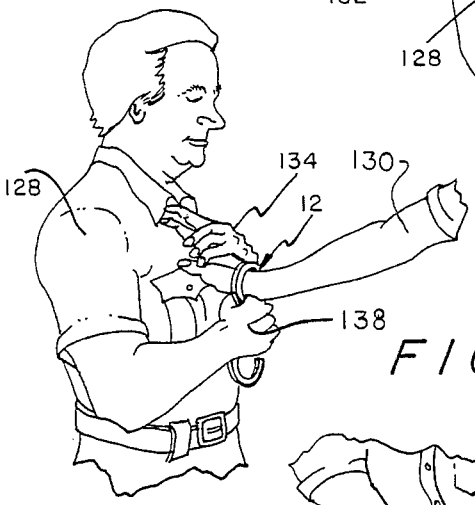
FIG. 8
FIG. 10
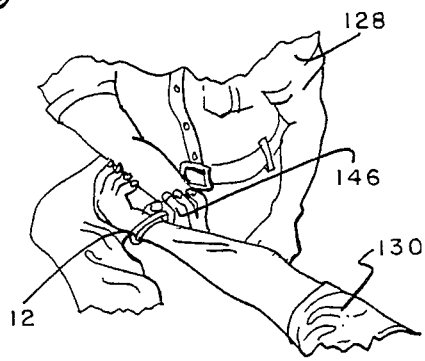
FIG. 11
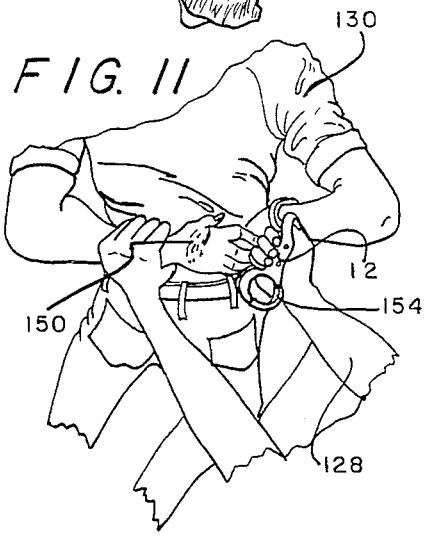

HANDCUFF RESTRAINING APPARATUS AND METHOD OF USE

"This is a continuation of application Ser. No. 898,660, filed Aug. 21, 1986 and now abandoned."

PRIOR ART

My invention is directed to (1) either an original manufactured and assembled handcuff restraining apparatus; or (2) to be attached to existing handcuffs which are normally handcuff bracelet members interconnected by a link chain member. The plate or handle members are to be grasped by one's hand so that the entire structure can be utilized to subdue a suspect without the use of a night stick or other lethal injury causing weapons.

A patentability investigation on the above identified invention revealed the following United States patents:

| Reg. No. | Title | Inventor |
|---|---|---|
| 647,735 | HANDCUFF | Widmayer |
| 1,456,846 | THUMB LOCK | Gamwell |
| 1,517,588 | HANDCUFF HOLDER | Sasaki |
| 1,736,890 | MANACLE | Gill |
| 3,146,614 | THUMB CUFF | Frantzius |
| 3,616,665 | HANDCUFF SHIELD | Rosenthal |
| 4,351,169 | RESTRAINING DEVICE | Plymale |

The Sasaski patent discloses a handcuff holder but it is substantially different in appearance and structure relative to my invention.

The Plymale patent discloses a restraining device made of resilient material but is substantially different in operation and function compared to my invention.

The Frantzius and Gamwell patents disclose "thumb cuffs" being lock structures each having a piece interconnecting the thumb lock feature.

The Gill patent discloses a manicle structure with a ratchet locking feature and a locking box between special handcuff bracelet members.

The Rosenthal patent discloses a handcuff shield which functions to (1) prevent one from breaking a chain member between handcuff bracelet; and (2) prevent one from opening the handcuff bracelet members easily even with a key due to the positioning of the lock structures.

It is noted that none of the cited patent references disclose the handcuff restraining apparatus of my invention operable through a method of use as set forth hereinafter.

HISTORY

The handcuff restraining apparatus of this invention is designed to be used by an arresting officer in place of a nightstick, PR-24, nunchakus, and other weapons used by police departments and arresting officers to apprehend a suspect and defend themselves from bodily injury. The handcuff restraining apparatus of this invention is not used in a striking, injury causing manner.

In the case of all weapons used by the arresting officer today, the apprehension of a suspect takes place in two (2) phases. In phase one, the suspect is rendered helpless either with a police weapon like a nightstick or a self-defense move. In phase two of the apprehension, the suspect must be handcuffed utilizing standard handcuff procedure. This separate procedure for applying handcuff bracelets requires that (1) the arm of the suspect must be twisted and moved behind the suspect's back whereupon one handcuff is placed on one wrist of the suspect; and (2) the suspect's other wrist is moved to the suspect's same back area to apply the other handcuff bracelet.

The prior method of arresting a suspect, in many situations, would appear life-endangering to the police officer and, in many cases, a nightstick may be used to excess on the suspect's body and head portion to render him helpless. Or, in certain cases, the arresting officer would draw his pistol in order to intimidate and arrest the suspect, which is a dangerous situation as the suspect may gain control of the pistol. If the pistol was discharged and caused injury to the suspect, the subject city and police department would, in many cases, be found guilty of using "excess force" in arresting the suspect and, would be found legally liable for damages as a result of such action. The handcuff restraining apparatus of this inventor is intended to eliminate excessive force necessary to render a suspect helpless and, substantially reduces the danger and possibility of bodily injury to the arresting officer.

PREFERRED EMBODIMENT OF THE INVENTION

In one preferred embodiment of the handcuff restraining apparatus and method of use of this invention, a handcuff restraining assembly is provided which is releasably mounted in a handcuff holster assembly which, in turn, is carried on a belt member worn by an arresting officer. The handcuff restraining assembly includes a handcuff assembly having a restraining assembly mounted thereon. The handcuff assembly resembles a conventional prior art structure having a pair of handcuff bracelet members interconnected by a connector chain member. The handcuff bracelet members are of a conventional nature each having a clasp member pivotally connected to a crescent shaped base adapted to be placed about a suspect's wrist area and locked thereto. The restraining assembly includes a main handle assembly having a left handle member and a right handle member placed about the connector chain member and a portion of the handcuff bracelet member of the handcuff bracelet member and secured to each other by a handle connector assembly. The left and right handle members are substantially identical but being opposite as mirrored images of each other. Each handle member is provided with a main handle body having arcuate end walls; a finger side wall with an arcuate finger section to receive a portion of a person's finger therein; an upward and outwardly projecting thumb side wall; an outer support wall having curved surfaces to receive a portion of a person's palm and fingers thereagainst; and an inner cavity wall having a chain cavity therein to receive and enclose the connector chain member of the handcuff assembly. The thumb sidewall is provided with a thumb base section having an upwardly, outwardly pressure projection adapted to receive the user's thumb thereagainst. The handle assembly operates in the assembled condition so as to receive a person's hand thereabout in a comfortable manner having specific curves and indentations therein necessary to achieve the overall function of the inventor. The handcuff restraining assembly further includes a handcuff holster assembly attachable to a belt member and operable to releasably secure and convey the handcuff assembly in the proper position for easy grasping and use by the arresting officer. This invention includes a method of operation of the handcuff restraining apparatus involving the steps of (1) holding the handcuff restraining assembly firmly in one's right or left hand; (2) grasping preferrably a portion of a suspect to be arrested so as to gain control of his wrist area; (3) moving a handcuff bracelet member against the suspect's wrist area to cause the clasp member to rotate throughout the crescent shaped base and back around so as to enclose the suspect's wrist area in a locked manner; (4) inclining the handcuff restraining assembly against the suspect's wrist area which causes pressure on the nerves therein so as to maintain control of the suspect; (5) twisting, if necessary, the handcuff restraining assembly to force the suspect to move to his knees because of the pain that can be caused in the wrist area; (6) grasping the other arm of the suspect so as to place the other wrist area in adjacent relationship to the other handcuff bracelet member of the handcuff assembly; and (7) moving and locking the other handcuff bracelet member about the suspect's other wrist area. The method of use of this invention also involves the carrying of the handcuff restraining assembly within a handcuff holster assembly in (1) a secure manner to prevent unintentional release therefrom; and (2) an inclined position for ease of grasping the handcuff restraining assembly and removing for subsequent use thereof.

OBJECTS OF THE INVENTION

One object of this invention is to provide a handcuff restraining apparatus having a specially deigned handle assembly which can be easily attached to existing handcuff assemblies which effectively alters the conventional handcuff assembly into the handcuff restraining apparatus of this invention.

One other object of this invention is to provide a handcuff restraining apparatus operable to have a restraining assembly mounted between spaced handcuff bracelet members of a conventional handcuff assembly and operates to achieve a rigid connection therebetween to achieve new and novel method of use of this invention.

Still, another object of this invention is to provide a handcuff restraining apparatus having a restraining assembly mounted between space handcuff bracelet members interconnected by a connector chain member and having outer contours, surfaces, and projections on the restraining assembly so as to be easily grasped, twisted, and controlled by an enforcement officer utilizing same.

Still, one further object of this invention is to provide a handcuff restraining assembly having a handcuff bracelet member readily connected about a suspect's wrist area and operable to be rotated and twisted by the arresting officer to provide nerve pinching techniques to the suspect's wrist area to render him helpless.

Another object of this invention is to provide a handcuff restraining apparatus which is simple in construction; readily attachable to existing handcuff assemblies as a conversion kit; easy to attach to a suspects wrist area; easy to use in order to render the suspect helpless; and operable to be properly conveyed in a handcuff holster assembly of this invention.

Still, one other object of this invention is to provide a handcuff restraining apparatus including a handcuff restraining assembly mountable and carried in a handcuff holster assembly in a proper inclined position and having restraining straps to prevent the unintentional or unauthorized removal of the handcuff restraining assembly from the handcuff holster assembly.

Still, another object of this invention is to provide a handcuff restraining assembly which can be readily grasped by an arresting officer utilizing same; easily removed from a support handcuff holster assembly; operable in a matter of seconds to be attached to a suspect's wrist area and render him helpless; and then easily attach another portion of the handcuff restraining assembly to the suspect's other wrist area.

Still, one further object of this invention is to provide a new and novel method of use of the handcuff restraining apparatus including a handcuff restraining assembly which is operable to be (1) initially connected to one of the suspect's wrist areas; (2) twisting of the handcuff restraining apparatus to render the suspect helpless; and (3) placing the suspect's other wrist area behind his back and into the handcuff restraining assembly to complete the arrest of the suspect with a minimum amount of danger, force, and effort.

One other object of this invention is to provide a handcuff restraining apparatus and method of use thereto which is sold as a complete unit; sold as a restraining assembly to be attached to existing handcuff assembly structures; easy to operate; substantially maintenance free; and providing numerous safety features to prevent undue injury to both the suspect and the arresting officer.

Various other objects, advantages, and features of this invention will become apparent to those skilled in the art from the following discussion, taken in conjunction with the accompanying drawings, in which:

FIGURES OF THE INVENTION

FIG. 1 is a perspective view of a handcuff restraining assembly of the handcuff restraining apparatus of this invention illustrated as secured to adjacent wrist areas of a suspect;

FIG. 2 is a top plan view of the handcuff restraining assembly;

FIG. 3 is a side elevational view of the handcuff restraining assembly;

FIG. 4 is an end elevational view of the handcuff restraining assembly;

FIG. 6 is a side elevational view of a handcuff restraining apparatus having the handcuff restraining assembly mounted and held within a handcuff holster assembly;

FIG. 7 is a side elevational view of the handcuff restraining apparatus as shown in FIG. 6; and FIGS. 8, 9, 10, and 11 disclose the method of use of the handcuff restraining apparatus of this invention as usable by an arresting officer on a suspect.

Figure 5:
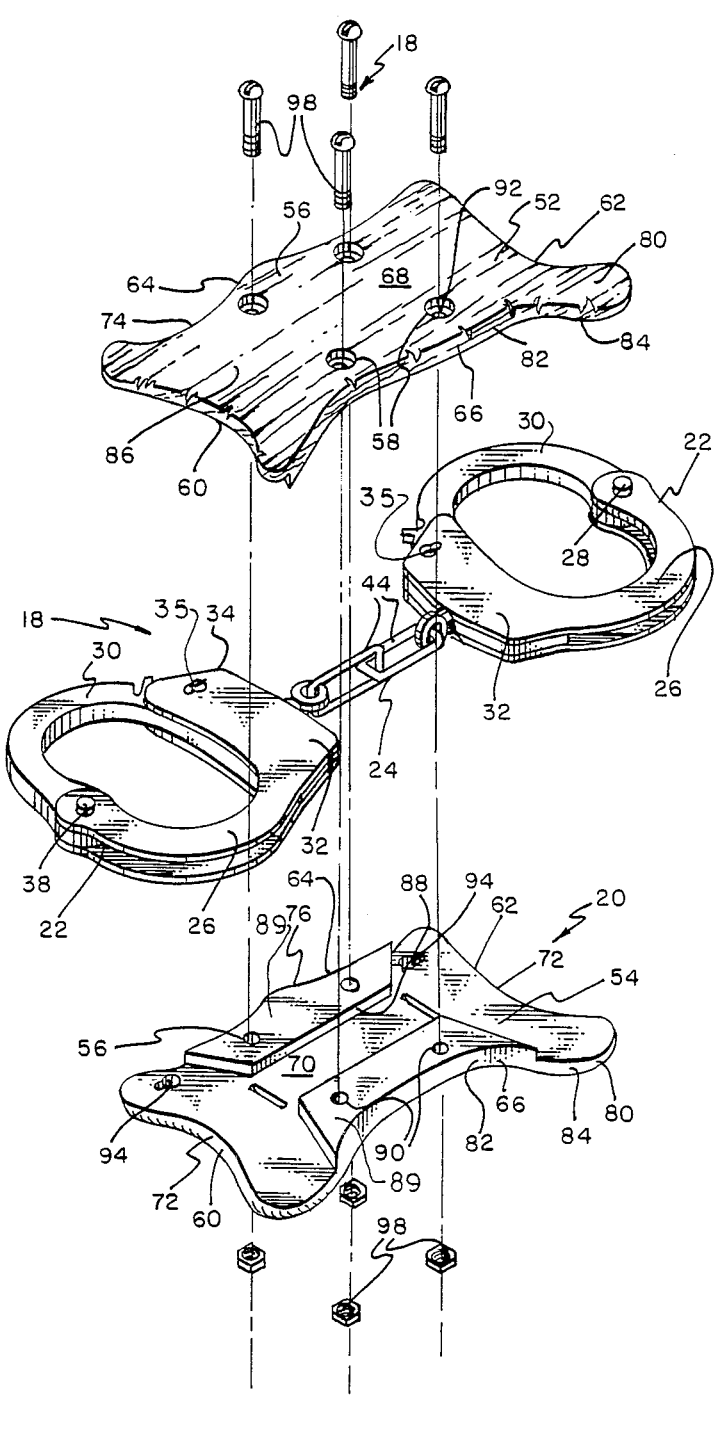
FIG. 5 is an exploded perspective view of the handcuff restraining assembly.

The following is a discussion and description of preferred specific embodiments of the handcuff restraining apparatus of this invention, such being made with reference to the drawings, whereupon the same reference numerals are used to indicate the same or similar parts and/or structure. it is to be understood that such discussion and description is not to unduly limit the scope of the invention.

DESCRIPTION OF THE INVENTION

On referring to the drawings in detail and in particular to FIG. 6, a handcuff restraining apparatus of this invention indicated generally at 12, includes a handcuff restraining assembly 14 which is releasably carried and mounted within a handcuff holster assembly 16. The handcuff restraining apparatus 12 is operable to be utilized by an arresting police officer by wearing on a belt member 15 indicated in dotted lines.

The handcuff restraining assembly 14 is operable to be placed about a suspect's wrist area 13 as noted in FIG. 1 when subdued by the method of use of this invention.

The handcuff restraining assembly 14 includes a substantially known or conventional handcuff assembly 18 having a restraining assembly 20 mounted thereon. The handcuff assembly 18 includes a pair of handcuff bracelet members 22 interconnected by a connector chain member 24. This resembles a conventional handcuff assembly 18 presently utilized by police enforcement officers whereupon the handcuff bracelet members 22 are flexible relative to each other due to the connector chain member 24 interconnecting same.

Each handcuff bracelet member 22 includes a crescent shaped base 26 having a clasp member 30 pivotally connected thereto by a connector member 28. Each crescent shaped base 26 is provided with a main support member 32 having a lock assembly 34 connected thereto. The lock assembly 34 is of a conventional nature having a lock opening 35 therein which is accessible through the use of a key member to selectively disconnect the clasp member 30 from a lock portion of the crescent shaped base 26.

The connector member 28 is a pivot pin 38 about which the clasp member 30 is pivotal.

The clasp member 30 is also of a crescent shape having a C-shaped support member 40 having a plurality of lock teeth members 42 on an inner periphery thereof. The locked teeth members 42 are engagable with a rachet assembly within the crescent shaped base 26 so as to be freely movable in one direction as indicated by an arrow 43 but not movable in the opposite direction after being placed on the suspect's wrist area 13. After engagement of the lock teeth members 42 with the rachet assembly, it requires a key member within the lock opening 35 in order to unlock the handcuff assembly 18.

The connector chain member 24 provides an interconnection of the handcuff bracelet members 22 by link members 44 in a substantially conventional manner.

The restraining assembly 20 includes a main handle assembly 46 constructed of half sections and interconnected by a handle connector assembly 48. The main handle assembly 46 is formed in mirrored image half sections similar to that found on a hand grip assembly on a revolver or pistol member. The main handle assembly 46 includes a left handle member 52 and a right handle member 54. It will be seen that the handle members 52, 54 are substantially identical but reversed so that together they form a hand grip assembly.

As best noted in FIG. 5, the left handle member 52 includes a main handle body 56 having a plurality of spaced connector openings 58 therein.

The main handle body 56 may be constructed of a rigid plastic or a carved wood construction includes (1) arcuate end walls 60, 62; (2) a finger side wall 64; (3) a thumb side wall 66; (4) an outer support wall 68; and (5) an inner cavity wall 70.

The arcuate end walls 60, 62 are provided with a curved section 72 which basically conform with a portion of the similarly curved portion of the respective crescent shaped bases 26 on the handcuff bracelet members 22.

The finger side wall 64 is provided with arcuate curved finger sections 64 having finger indentations 76. The finger indentations 76 are curved inwardly towards the center of the main body handle 56 and adapted to receive portions of a person's fingers therein for grasping thereof similar to a knife or pistol handle. The finger indentations 76 curve about and towards the center of the outer support wall 68 for ease of grasping.

The thumb side wall 66 includes a main thumb base section 80 having a palm base section 82 integral therewith. The thumb base section 80 provides an upwardly extending pressure projection point 84 which is operable to receive a person's thumb thereagainst to ease in maneuverability of the entire handcuff restraining assembly 14 in a manner to be explained in detail.

The outer side wall 68 is provided with a curved surface 86 which conforms and is integral with the finger indentations 76 of the finger side wall 64 to further receive the outer end most portions of a person's finger members thereagainst. A little finger indentation 77 is very important in use of this invention as will be explained.

The inner cavity wall 70 is provided with a connector chain cavity 88 which receives the connector chain member 24 therein when the left handle member 52 is connected to the right handle member 54 by the handle connector assembly 48. The inner cavity wall 70 also includes a support surface 89 which abuts the adjoining support surface 89 when in the assembled condition of the restraining assembly 20.

The connector openings 58 are provided with a plurality, namely four of holes 90, each having a stepped section 92 surrounding same. The stepped sections 92 are operable to receive the handle connector assembly 48 therein so as to be positioned below the outer portion of the curved surfaces 86 of the outer support walls 68.

The handle connector assembly 48 consists of a plurality of nut and bolt members 98 to interconnect the left handle member 52 to the right handle member 54 in the assembled condition noted in FIGS. 2 and 4.

The right handle member 54 is substantially identical to the previously described left handle member 52 except being a mirrored image thereof. The right handle assembly 54 includes a main handle body 56 having the connector openings 58 therein and, additionally, keyhole openings 94.

The main handle body 56 includes (1) arcuate end walls 60, 62; (2) a finger side wall 64; (3) a thumb side wall 66; (4) an outer support wall 68; and (5) an inner cavity wall 70. The above subject walls and the connector openings 58 are as previously described.

The keyhole openings 94 are spaced at opposite sides so as to be positioned above the respective lock openings 35 on the lock assemblies 34 on the crescent support base 26 of each respective handcuff bracelet member 22. It is obvious that the keyhole openings 94 are necessary to permit an access for a lock key for unlocking the lock assemblies 34 on the handcuff bracelet members 22.

The handle connector assembly 48 includes a plurality of nut and bolt members 98 which are placed in the stepped sections 92 so as to be positioned below the curved sections 86 of the outer support walls 68.

As best noted in FIGS. 6 and 7, the handcuff holster assembly 16 is of a special construction and design necessary to hold the handcuff restraining assembly 14 in such a manner to not interfere with the movements of the arresting officer in his normal activities but being easily grasped when needed to be utilized. The handcuff holster assembly 16 includes (1) a main handcuff support assembly 102; (2) a belt support assembly 104 connectable to the belt member 15; and (3) a handcuff anchor assembly 106 secured to the main handcuff support assembly 102.

The main handcuff support assembly 102 includes a support base 108 having a curved arcuate cover member 110 anchored thereto as by stitching 111 about a portion of an outer periphery. The arcuate cover member 110 is of a size slightly greater than a respective handcuff bracelet member 22. The handcuff bracelet member 22 being the one that is furtherest away from the thumb base sections 80, as noted in FIG. 6, is placed through an inlet opening 112 in the cover member 110 and held in an inclined position.

The belt support assembly 104 includes a connector flap member 114 secured to the support base member 108 and further secured at an outer periphery to the inner adjacent portion of the support base 108 to provide a belt opening 116 therein to obviously receive the belt member 15 therethrough.

The handcuff anchor assembly 106 includes a lateral anchor assembly 107 and a vertical anchor assembly 123 which cooperate to retain the handcuff restraining assembly 14 in the handcuff holster assembly 16 until desired to be intentionally removed therefrom.

The lateral anchor assembly 107 includes an anchor base member 118 having an integral connector strap 120 with the end thereof connected to the anchor base member 118 by an anchor assembly 122.

The anchor assembly 122 can be velcro connectors 124 or snap members (not shown) if so desired.

The vertical anchor assembly 123 includes a connector strap 129 which is adapted to be placed over the adjacent arcuate end walls 62 and secured as by an anchor assembly 122 in the enclosed condition is shown in FIG. 6. Again, it is obvious that the anchor assembly 122 may be the velcro members 124 or snap members as deemed necessary.

In the new and novel method of use of the handcuff restraining apparatus 12 of this invention as noted in FIGS. 8-11, inclusive, the steps of the method of use as described will begin with the handcuff restraining assembly 14 mounted in the handcuff holster assembly 16 (per FIG. 6) and worn on the belt member 15 of an arresting officer involves the steps of:

1. unclasping of the lateral anchor assembly 106 and the vertical anchor assembly 123 whereupon the connector straps 120 and 129 are released from their respective anchor assemblies 122; and the handcuff restraining assembly 14 can be grasped as shown in dotted outline of a person's hand in FIG. 6;

2. grasping and holding the handcuff restraining assembly 14 in one's hand in a manner to be used;

3. moving the handcuff restraining assembly 14 so as to place an outer surface of the front clasped member 30 against the suspect's wrist area 13 and pivoting the clasp member 30 thereabout for locking as shown in FIG. 8;

4. inclining the handcuff restraining assembly 14 as noted in FIG. 9 to place pressure on the suspect's wrist area 13 to provide contact with the inner surfaces of the crescent shaped base 26 and the clasp member 30 to provide nerve pressure thereagainst whereupon the suspect can be moved to his knees if deemed necessary;

5. twisting the handcuff restraining assembly 14 as noted in FIG. 10 in order to move the entire arm and suspect's wrist area 13 to a position behind his back;

6. grasping the suspect's other wrist area 13; and 7. connecting as noted at 154 the other handcuff bracelet member 22 of the handcuff restraining assembly 14 to the suspect's other wrist area 13 so as to achieve the final restraining effort rendering the suspect under control or helpless as noted in FIG. 1.

It is noted that the new and novel method of use of the handcuff restraining assembly 12 of this invention is operable in an efficient, effective, and easy manner without the use of police clubs, pistols, or other injury causing methods.

USE OF OPERATION OF THE INVENTION

In the use and method of operation of the handcuff restraining apparatus 12 of this invention, the handcuff restraining assembly 14 can be readily mounted within the handcuff holster assembly 16 and held therein by the handcuff anchor assembly 106 as noted in FIGS. 6 and 7. At this point, it is obvious that the officer utilizing the invention can place the belt support assembly 104 on its respective belt member 15 by inserting through the belt opening 116. It is noted that the handcuff holster assembly 16 is preferrably mounted inwardly from the officer's right front pant pocket (if right handed) so as to not be in the way when necessary to remove and grasp for restraining a suspect. It is obvious that the handcuff holster assembly 16 can be constructed so as to have the elements of the main handcuff support assembly 102 and the handcuff anchor assembly 106 placed on opposite sides thereof so it can be inclined and positioned inwardly from the left front pant pocket if the officer is left handed.

On use of the handcuff holster assembly 12, the handcuff restraining assembly 14 can be removed from the handcuff holster assembly 16 on grasping as shown by the officer's hands in dotted lines in FIG. 6. Of course, the handcuff anchor assembly 106 with the connector strap 120 and the connector strap 129 would be released to permit removal of the handcuff restraining assembly 14.

On restraining a suspect, the arresting officer would normally be face to face and grasp the suspect's right wrist area 13 with the officer's left hand (if right handed) and having the handcuff restraining assembly 14 carried in his right hand. Of course,the suspect may have a gun or knife in his right hand and the officer would grasp the wrist area and immediately force the upper outer most handcuff bracelet member 22 which is adjacent and outwardly of the thumb side walls 66 against the suspect's right wrist area 13. On contacting the suspect's wrist area 13, the clasp member 30 freely rotates as shown by the arrow 43 so as to circle the suspect's wrist area 13 whereupon the lock teeth members 42 on the clasp member 30 are engaged with similar rachet structures in the crescent shaped base 26. This locks the subject handcuff bracelet member 22 on the suspect's wrist area 13 as noted in FIG. 8.

Next, the restraining officer moves, as noted in 138, the handcuff restraining assembly 14 in an inclining manner 142 and twisting movement 146 as noted in FIG. 10 so as to twist the suspect's arm and subject wrist area 13 behind his back as noted in FIG. 11.

At this point, the restraining officer grasps, as indicated at 150, the suspect's other arm and specific wrist area 13 to move the same rearwardly for attachment with the other handcuff bracelet member 22. At this time, the other clasp member 30 of the other crescent shaped base 26 is again freely pivotal as shown by arrow 43 and is moveable about the suspect's other wrist area 13 for connecting as shown at 154.

At this time, both of the suspect's arms are adjacent his back portion and the wrist areas 13 are interconnected in a manner as shown in FIG. 1 wherein the suspect is rendered under control of the restraining officer.

It is seen that the handcuff restraining apparatus of this invention includes the specially designed restraining assembly adapted to be sold as a new manufactures assembled unit or as a kit form to be readily connected to a standard set of conventionally available law enforcement handcuffs. The handcuff restraining assembly of this invention is operable to be utilized as a non-lethal weapon by law enforcement officers to subdue a suspect or defend himself against an attack from the subject suspect.

With the use of the handcuff restraining assembly of this invention, the suspect is apprehended and handcuffed by the arresting police officer by a smooth movement thereby eliminating the need of separate, extensive, self-defense training by the law enforcement officer.

The handcuff restraining assembly of this invention is operable by utilizing the handcuff bracelet members held rigidly relative to each other by the restraining assembly and using the inner edges of the handcuff bracelet members to apply pressure to the sensitive radial and ulnar nerves located in the suspect's wrist area. The application of this pressure to the subject nerves is only possible through the new and novel design of the handcuff restraining assembly of this invention.

The new and novel design of the main handle assembly of the restraining assembly of this invention allows for a fast draw of the handcuff restraining assembly from the handcuff holster assembly and operable to apply maximum pressure through the special design of the thumb side walls. Also, the right portion of the thumb side walls are grooved to fit the palm and thumb surface of the arresting officer's hand to allow a secure gripping. Additionally, the palm base section of the thumb side wall is operable to fit the curve of the officer's upper palm and web of the hand.

The new and novel design of the finger side wall of the handle member of this invention allows for separation for the four (4) finger members in the center thereof for maximum control. The bottom edge thereof contains a special groove for the little finger so it will not slip from the main handle assembly. This is very important as, on testing, it is found that the little finger indentation provides the power and strength for being grasped by the arresting officer and, therefore, this indentation for the little finger is very important.

It is noted that the non-lethal technique of the handcuff restraining assembly of this invention is very important as can be used against the suspect's fist, guns, knives, clubs, or any other weapons that the suspect might use to resist arrest from arresting officer. All of the above noted actions are accomplished in an easy and non-lethal method which is the true value and acceptance of the new and novel handcuff restraining apparatus of this invention.

It is seen that the handcuff restraining apparatus is readily operable to be placed on existing handcuff assemblies in the field or can be manufactured as a complete unit; is readily attached to the arresting officer so as to be easily conveyed and readily available when needed in an emergency; is relative simple in construction; is efficient and effective in use and operation; economical to manufacture; and substantially maintenance free.

While this invention has been described in conjunction with preferred specific embodiments, it will be understood that this description is intended to illustrate and not to limit the scope of the invention, which is defined by the following claims.

I claim:

1. A handcuff restraining assembly adapted to be used by a law enforcement officer or the like to restrain a suspect, comprising:

(a) a handcuff assembly having a pair of handcuff bracelet members interconnected by a connector member;

(b) said handcuff bracelet members having a clasp pivotally connected to a base member operable to restrain and selectively anchor a suspect's wrist area therein;

(c) a restraining assembly connected about a portion of said handcuff bracelets and enclose said connector member to provide a rigid, non-moving interconnection between said handcuff bracelet members and said restraining assembly; and (d) said restraining assembly having a main handle assembly the size and configuration operable to receive the restraining officer's hand thereabout and to provide firm gripping thereof so as to move said handcuff bracelet members in an inclined and twisting manner as required.

2. A handcuff restraining assembly as described in claim 1, wherein:

(a) said main handle assembly is provided with left and right hand handle members interconnected by a handle connector assembly to prevent relative movement between said connector member and said handcuff bracelet members; and (b) said left and right handle members each having a main handle body provided with a finger side wall and an outwardly projecting thumb side wall projection operable to receive the arresting officer's thumb portion thereon to provide for easy movement during a restraining and suspect control operation.

3. A handcuff restraining assembly as described in claim 2, wherein:

(a) said finger side wall having arcuate finger sections operable to receive the middle three fingers on one's hand and having a finger indentations operable to receive the fingers therein for ready grasping thereof; and (b) said main handle assembly including a little finger indentation in said left and right handle members operable to receive one's little finger thereabout for applying pressure with one of said handcuff bracelet members operable with the officer's little finger by one's thumb against said thumb side wall projection.

4. A handcuff restraining assembly as described in claim 3, wherein:

(a) said thumb side wall projection having a thumb base section integral with a palm base section; and (b) said thumb base section having an outwardly projecting pressure projection, whereby operable with the arresting officer's thumb and thumb base and palm portion operable to rest against said palm base section with the thumb portion against said pressure projection to allow for ready grasping and moving said handcuff restraining assembly.

5. A handcuff restraining assembly adapted to be utilized by an arresting officer on a suspect to render same under control and helpless, comprising:

(a) a handcuff assembly having a pair of spaced handcuff bracelet members;

(b) a restraining assembly having a main handle assembly to interconnect said handcuff bracelet members in common planes and provide a rigid non-moving interconnection between said handcuff bracelet members and said restraining assembly;

(c) said main handle assembly provided with an outer finger side wall having arcuate finger sections and finger indentations therein operable to receive the officer's finger portions therein;

(d) said main handle assembly having outer support walls each having a curved surface to conform and receive the officer's palm and finger members thereabout; and (e) said main handle assembly including a thumb side wall having a thumb base section with a pressure projection operable to receive the officer's thumb thereagainst.

6. A handcuff restraining assembly as described in claim 5, wherein:

(a) said finger indentations having a little finger indentation operable to receive one's little finger thereagainst to provide the major twisting and turning movement of the entire said handcuff restraining assembly when operable to be attached to the wrist area of the suspect being apprehended and restrained.

7. A handcuff restraining assembly as described in claim 5, including:

(a) a handcuff holster assembly adapted to be supported on a belt member worn by the restraining officer;

(b) said handcuff holster assembly includes a main handcuff support assembly having a support base member with a cover member thereon with an upper inlet opening;

(c) said support base member and interconnected said cover member operable to be at an angle relative to the belt member on the restraining officer's belt;

(d) said hancuff assembly having one of said handcuff bracelet members releasably mounted in said inlet opening of said main hancuff support assembly in an inclined manner adapted for readily grasping of said main handle assembly by the officer utilizing the same and operable so that his thumb portion is immediately placed against said thumb side wall for ease of grasping and removing from said handcuff holster assembly; and (e) a portion of said main handle assembly and another one of said handcuff bracelet members extended upwardly and outwardly of said main handcuff support assembly whereby said main handle assembly is readily grasped by the officer using same.

8. A handcuff retraining apparatus as described in claim 7, wherein:

(a) said hancuff holster assembly provided with a handcuff anchor assembly having a connector strap member to engage an upper outer surface of said main handle assembly of said hancuff assembly and releasably hold the same within said handcuff holster assembly.

9. A handcuff retraining apparatus as described in claim 7 wherein:

(a) said handcuff holster assembly includes a handcuff anchor assembly having a pair of said connector straps one of which is placed above said main handle assembly to hold against lateral movement and a second one of said connector straps placed between an opening in said another one of said handcuff bracelet assemblies to prevent axial movement of said handcuff restraining assembly until so desired by the restraining officer.

10. A handcuff restraining apparatus as described in claim 8 wherein:

(a) said handcuff anchor assembly includes a transverse anchor member selectively placed within said another one of said handcuff bracelet members to selectively anchor said handcuff assembly against axial movement.

11. A method of restraining a suspect by an arresting officer utilizing a handcuff restraining apparatus of this invention, comprising:

(a) holding said handcuff restraining apparatus in one of a restraining officer's hands, said handcuff restraining apparatus includes a handcuff restraining assembly with a pair of handcuff bracelet members interconnected by a restrainer assembly being a rigid interconnected structure; said restrainer assembly having left and right handle members jointly forming a hand grip assembly for ease of holding, moving, and using by the arresting officer;

(b) moving one of said handcuff bracelet members of said handcuff restraining assembly against a wrist area of the suspect and having the subject said one of said handcuff bracelet members secured about the wrist area; and (c) inclining said handcuff bracelet member on the wrist area of the suspect in such a manner so as to provide pressure against a nerve area of the subject clasped wrist area for subduing and controlling the suspect.

12. A method of use as described in claim 11, including:

(a) wearing a handcuff holster assembly on a belt member on the officer; and (b) releasably mounting said handcuff restraining assembly in said handcuff holster assembly.

13. A method of use as described in claim 12, wherein:

(a) grasping said handcuff restraining assembly about said restrainer assembly to move upwardly from said handcuff holster assembly; and (b) placing one of said handcuff bracelet members about the wrist area of the suspect in one swift operation not requiring movement of the officer's grasp on said restraining assembly.

14. A method of use as described in claim 11, wherein:

(a) a further step of twisting said handcuff bracelet member about the wrist area of the suspect in such a manner so as to move an arm having the clasped wrist area behind a back area of the suspect being subdued.

15. A method of use as described in claim 11 wherein:

(a) grasping an other arm of the subject suspect by the arresting officer and moving rearwardly into a position adjacent to the other one of said handcuff bracelet members; and (b) connecting the said one one of said handcuff bracelet members to a wrist area of said other arm of the suspect being subdued;

whereby both of the wrist areas of subject suspect are interconnected in a rigid manner between said handcuff bracelet members behind the suspect being subdued.

* * * * *